US005487399A

United States Patent [19]

Hannah

[11] Patent Number: 5,487,399

[45] Date of Patent: Jan. 30, 1996

[54] PAINT ROLLER CLEANER

[76] Inventor: Dale A. Hannah, 13260 Welch St., Waterford, Calif. 95386

[21] Appl. No.: 409,860

[22] Filed: Mar. 23, 1995

[51] Int. Cl.[6] ..... B08B 3/02

[52] U.S. Cl. ..... 134/138; 134/152; 134/170; 134/900

[58] Field of Search ..... 134/900, 138, 134/152, 170

[56] References Cited

U.S. PATENT DOCUMENTS

| | | | |
|---|---|---|---|
| 3,688,785 | 9/1972 | Stevens et al. | 134/900 X |
| 4,218,265 | 8/1980 | Fuchs et al. | 134/170 X |
| 4,299,245 | 11/1981 | Clapper | 134/170 X |
| 4,402,333 | 9/1983 | Frizzell et al. | 134/900 X |
| 4,733,679 | 3/1988 | Dolcater | 134/138 |
| 5,409,027 | 4/1995 | Glunt | 134/900 X |

*Primary Examiner*—Philip R. Coe
*Attorney, Agent, or Firm*—Mark D. Miller

[57] ABSTRACT

A hollow tubular housing is provided having a freely rotatable support frame for holding a paint roller pad while cleaning. The housing is closed at one end and includes a series of openings down one side. A movable spray-tube is provided on the outside of the housing and includes a series of spray jets which correspond to the openings to spray water into the housing. The movability of the spray tube allows the user to change the direction of the water spray before or during cleaning in order to vary the speed and/or direction of the rotating roller pad inside. A second spray tube having a series of spray-openings therein is fixedly provided as the center shaft of the rotating internal support frame. A closable valve on the outside spray tube allows the user to adjust the flow of water to the sprayers. A specially formed gapped end piece is provided in the support frame to allow water from the inside spray tube to escape.

8 Claims, 2 Drawing Sheets

PAINT ROLLER CLEANER

BACKGROUND OF THE INVENTION

The present invention relates to paint rollers, and in particular to a new and improved cleaning device for paint roller pads.

A common tool used in wall painting is the paint roller. Most such rollers include a handle attached to a rotatable cage over which a tubular roller pad is slidably placed. The outside surface of the roller pad is made of fabric or material which becomes saturated with paint while in use.

There are many known methods of cleaning the paint from the roller pad after use ranging from the use of a high pressure water hose to discarding and replacing the roller pad. There are also several different devices used to assist in the roller pad cleanup process including flushing buckets (e.g. U.S. Pat. No. 4,708,152), flushing tubes (e.g. U.S. Pat. No. 4,155,230), jet sprayers (e.g. U.S. Pat. No. 3,818,529) and scrapers (e.g. U.S. Pat. No. D-265,940).

The paint roller cover cleaner device of U.S. Pat. No. 4,733,679 includes an elongated hollow housing that is closed at one end, the inside of which includes a rotatable roller cover holder and a spray tube. However, this apparatus does not provide for complete cleaning of the paint roller, particularly the inside (and ends) thereof; nor does it provide for easy reversal of the spinning direction of the roller cover to improve cleaning while in use.

SUMMARY OF THE INVENTION

The present invention allows for more convenient and complete paint roller pad cleaning by providing a hollow tubular housing having a freely rotatable support frame for holding a paint roller pad mounted therein. The housing is closed at one end and includes a series of openings down one side. A movable spray tube is provided on the outside of the housing and includes a series of spray jets which correspond to the openings in the housing. The movability of the spray tube allows the user to change the direction of the water spray before or during cleaning in order to vary the speed and/or direction of the rotating roller pad inside the housing.

A second spray tube having a series of spray openings therein is fixedly provided in the center shaft of the rotating internal support frame, and is used to clean the inside of the roller pad. A closable valve on the outside spray tube allows the user to adjust the flow of water to the spray tubes. A specially formed gapped end piece is provided in the support frame to allow water from the inside spray tube to escape.

It is therefore a primary object of the present invention to provide an apparatus for efficiently cleaning the inside and outside of a removable paint roller pad.

It is a further important object of the present invention to provide an apparatus for cleaning a paint roller pad which includes a cylindrical housing that is open on one end, a centrally located rotatable support frame over which a roller pad may be slidably placed, and two sets of sprayers which spray, respectively, the outside and inside of the roller pad in order to spin and clean it.

It is a further important object of the present invention to provide an apparatus for cleaning a paint roller pad which includes a set of adjustable water sprayers along the outside of a cylindrical housing which may be shifted in order to change the speed and/or direction of the rotating roller pad inside the housing as it is being cleaned, thereby facilitating more thorough cleaning.

It is a further important object of the present invention to provide an apparatus for cleaning a paint roller pad which includes a centrally located set of sprayers for cleaning the inside of the roller pad.

It is a further important object of the present invention to provide an apparatus for cleaning a paint roller pad which includes a specially designed central support frame that allows water to exit from the center of the tubular roller pad as it is being cleaned.

Additional objects will become apparent from the detailed description and the claims herein.

DETAILED DESCRIPTION OF THE DRAWINGS

Figure 1:
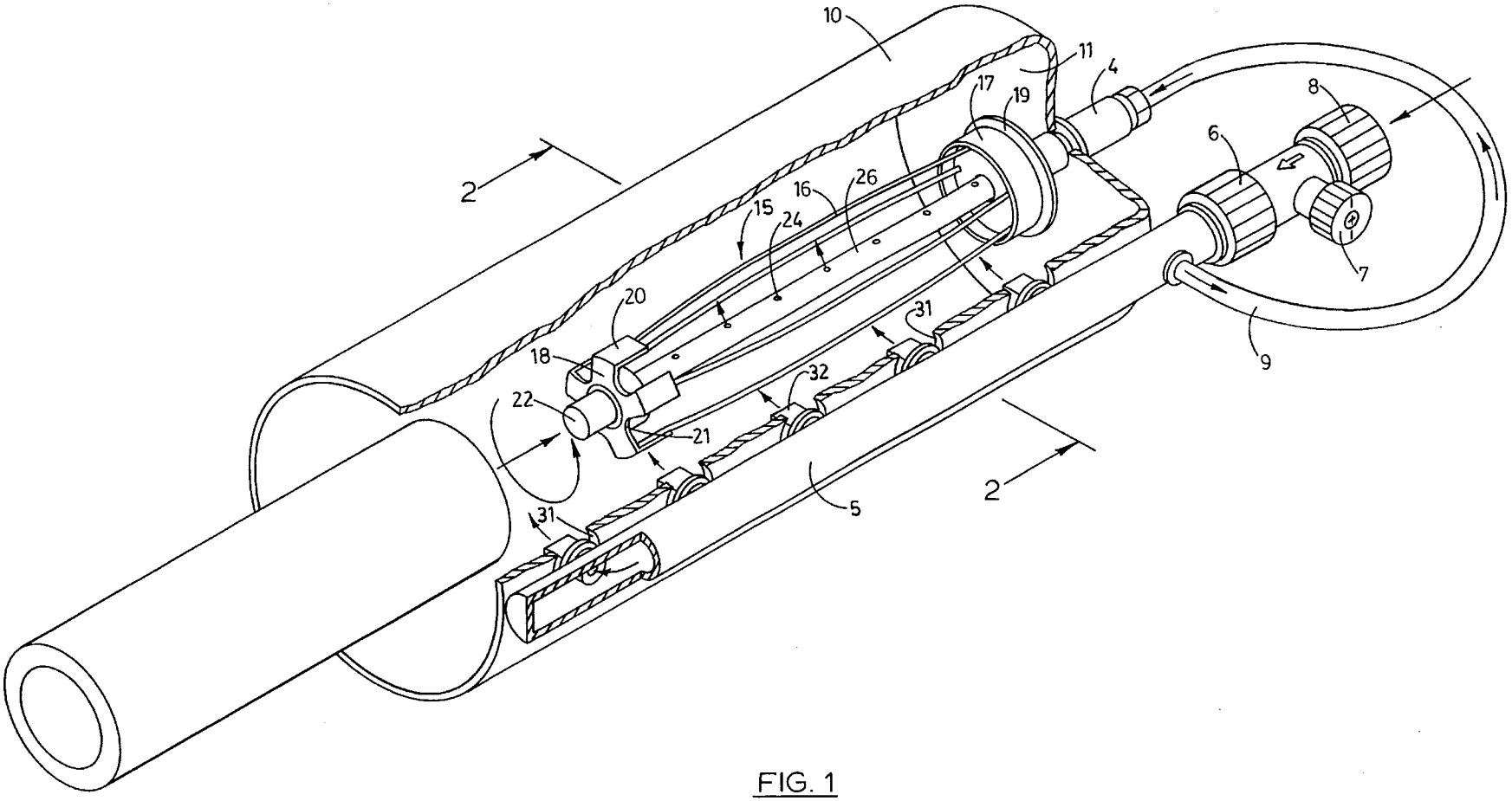
FIG. 1 is a perspective partially cut-away view of the present invention without a roller pad in place.
Figure 2:
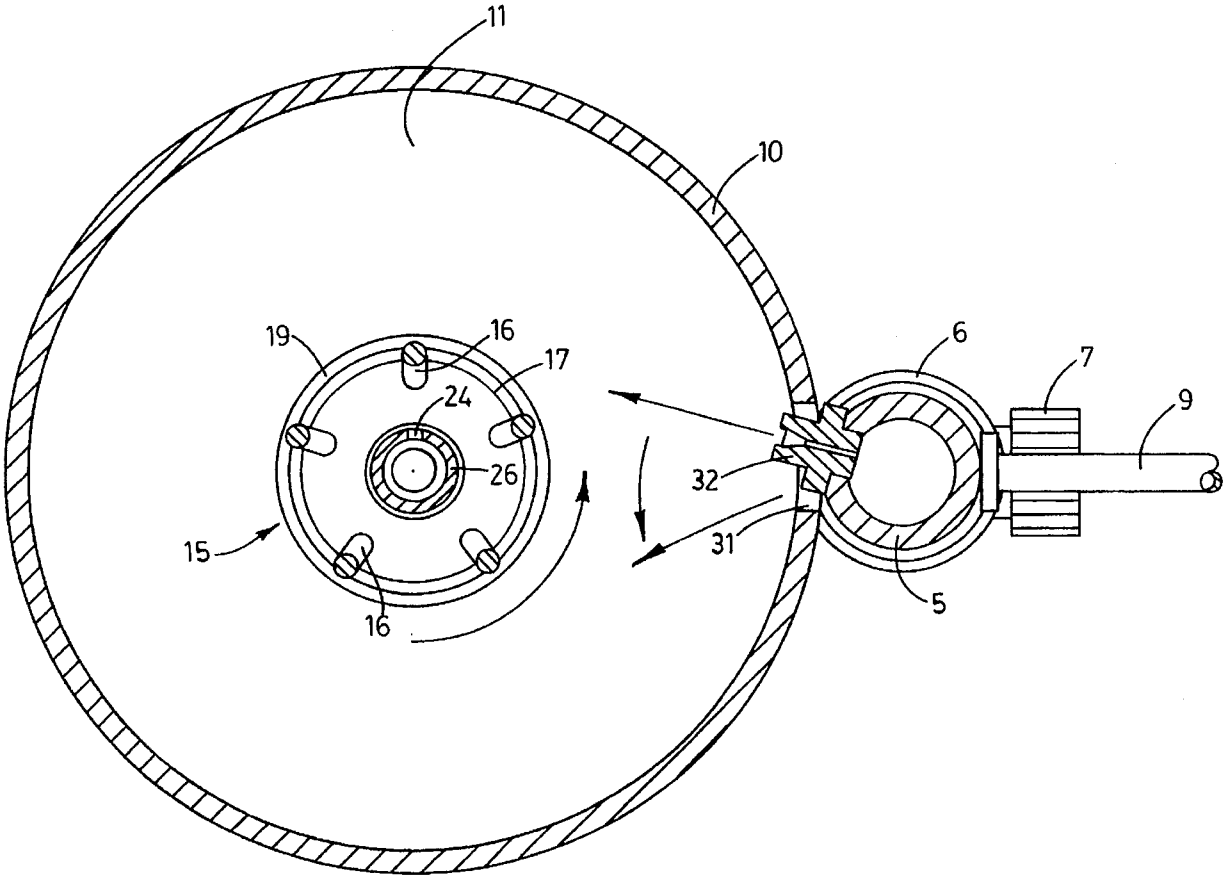
FIG. 2 is a cut-away view of the present invention along lines 2—2 of FIG. 1, showing the shiftability of the outside tube of spray jets.

Referring to the drawings wherein like reference characters designate like or corresponding parts throughout the several views, and referring particularly to FIGS. 1 and 2, it is seen that the invention includes a cylindrical housing 10 that is closed at one end 11. A series of large axial openings 31 are provided in a line in the cylinder wall housing 10. A large tubular shaft 5 is shiftably mounted on the outside of housing 10 which has a set of sprayers 32 which correspond to openings 31. One end of shaft 5 is closed, and the other end is attached to a valve means 6, 7 which is, in turn, attached to a water source at 8 (such as a hose). Valve 7 is used to control the flow of water to the apparatus. A separate flexible conduit line 9 is provided which connects from shaft 5 below valve 7 to the center of wall 11. Line 9 provides water to a central tube 26 inside housing 10. A second valve (not shown) can be included on conduit line 9 to provide separate control of water to central tube 26.

The sprayers 32 on shaft 5 are attached at an angle in order to cause the roller pad and support frame to rotate when water is introduced. Shaft 5 may be shifted as shown by the arrows in FIG. 2 to slow or reverse the direction of spin of the roller pad on the support frame.

A rotatable roller pad support frame 15 is provided at the center of housing 10. Frame 15 includes five support spines 16 which are attached between end segments 17 and 18. Segment 17 is in the form of a cylindrical base having an annular lip 19 which serves as a stop to the roller pad as it is slided over frame 15. Segment 18 includes a set of flanges 20 which correspond to each of the tines 16. Gaps 21 are provided between the flanges to allow water to escape.

A central bore is provided in each segment 17 and 18 which allows frame 15 to be slided over hollow tubular shaft 26. Shaft 26 is centrally mounted and fixed to wall 11, and is connected to line 9 through a central bore in wall 11. Plug 22 is attached to the end of shaft 26 and prevents frame 15 from sliding off while also capping the flow of water inside shaft 26. A series of outlets 24 in the form of small axial openings which act as sprayers are provided along shaft 26.

DESCRIPTION OF THE PREFERRED EMBODIMENTS

In the preferred embodiment, housing 10 of the present invention is made of a lightweight but sturdy material such as plastic or aluminum. The component parts of frame 15 may likewise be made of the same kind of sturdy material. Tubes 5 and 26 should be made of metal in order to provide better support for frame 15 and sprayers 32. The holes in tube 5 should be small enough that they cause a strong spray at relatively low water pressure. Sprayers 32 should likewise provide a strong spray at low pressure, and are removable in order to allow easy replacement.

In use, a paint roller pad is slided over rotatable frame 15. Water is then introduced to the apparatus by opening valve 7. Water is then sprayed on the outside of the pad through angled sprayers 32, causing the pad to rotate rapidly. This rapid rotation flings paint off the pad, cleaning it. Meanwhile, the fixed spray openings 24 on internal shaft 26 cause the inside of the pad to be cleaned at the same time. By shifting the position of shaft 5, the direction of sprayers 32 may be changed. This allows the user to reverse the direction of spin, and adjust the device for maximum spin in either direction.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. A paint roller pad cleaning device comprising:

a. a hollow cylindrical housing that is closed on one end having a plurality of openings longitudinally spaced along the outside thereof;

b. a first hollow shaft shiftably attached to the outside of said housing, said shaft having a plurality of sprayers mounted thereon corresponding to said longitudinal openings, said sprayers pointing to the inside of said housing;

c. a valve means and water source attached to said first shaft;

d. a rotatable paint roller pad support frame centrally attached inside said housing, said frame surrounding a second fixed hollow shaft attached to the closed end of said housing;

e. a plurality of spray openings in said second shaft; and f. a conduit means for connecting said first shaft to said second shaft.

2. The cleaning device referred to in claim 1 wherein a second valve means is provided on said conduit means.

3. The cleaning device referred to in claim 2 wherein one end of said support frame is attached to the inside of the closed end of said housing, and the opposite end thereof is provided with a plurality of openings through which water may escape when a roller pad is in place over said frame.

4. The cleaning device described in claim 3 wherein the opposite end of said frame is in the shape of a star having five openings between the arms of the star.

5. A paint roller cleaning device comprising a hollow cylindrical housing that is open at one end and closed at the opposite end, a support frame rotatably internally attached to the center of the closed end of said housing, said frame including a hollow cylindrical central tube having a plurality of holes therein, a second hollow tube attached to the outside of said housing, said second tube having a plurality of jet sprayers longitudinally mounted thereon, a series of openings in said housing corresponding to the sprayer jets on said second tube, first conduit means for connecting said central tube to said outside tube, second conduit means for connecting said outside tube to a water source, and a valve means in a said second conduit.

6. The cleaning device referred to in claim 5 wherein a second valve means is provided on said first conduit means.

7. The cleaning device referred to in claim 6 wherein one end of said support frame is attached to the inside of the closed end of said housing, and the opposite end thereof is provided with a plurality of openings through which water may escape when a roller pad is in place over said frame.

8. The cleaning device described in claim 7 wherein the opposite end of said frame is in the shape of a star leaving five openings between the arms of the star.

* * * * *